US005411464A

United States Patent [19]

Calvert et al.

[11] Patent Number: 5,411,464

[45] Date of Patent: May 2, 1995

[54] MACHINE FOR ERECTING CARTONS HAVING COLLAPSIBLE BOTTOMS

[75] Inventors: Rodney K. Calvert, Dunwoody; Alton J. Fishback, Austell, both of Ga.

[73] Assignee: The Mead Corporation, Dayton, Ohio

[21] Appl. No.: 153,209

[22] Filed: Nov. 16, 1993

[51] Int. Cl.[6] ..... B31B 3/80; B31B 5/78; B31B 3/50

[52] U.S. Cl. ..... 493/315; 493/317; 493/139

[58] Field of Search ..... 493/125, 315, 316, 317, 493/139

[56] References Cited

U.S. PATENT DOCUMENTS

| | | | |
|---|---|---|---|
| 3,044,371 | 7/1962 | Gastright | 493/309 |
| 3,242,827 | 3/1966 | Winters | 493/315 |
| 3,564,980 | 2/1971 | Winters | 493/317 |
| 3,956,976 | 5/1976 | Vogel et al. | 493/315 |
| 4,194,442 | 3/1980 | Martelli | 493/315 |
| 4,605,393 | 8/1986 | Krieger et al. | 493/317 |
| 4,871,348 | 10/1989 | Konaka | 493/315 |
| 5,102,385 | 4/1992 | Calvert | 493/315 |
| 5,104,369 | 4/1992 | Calvert | 493/315 |

*Primary Examiner*—William E. Terrell
*Attorney, Agent, or Firm*—Rodgers & Rodgers

[57] ABSTRACT

A carton having a collapsed bottom wall is erected by a machine which engages opposed side walls and draws these walls apart. Simultaneously the side walls are separated by movement in a transverse direction and the bottom wall panels are interlocked.

9 Claims, 3 Drawing Sheets

MACHINE FOR ERECTING CARTONS HAVING COLLAPSIBLE BOTTOMS

TECHNICAL FIELD

This invention relates to packaging of primary articles such as bottles in cartons and is particularly concerned with feeding such cartons having collapsed bottoms and for erecting the cartons in set up condition.

BACKGROUND ART

U.S. Pat. No. 3,027,815 issued Apr. 3, 1962 discloses a machine for dispensing and setting up collapsed cartons.

U.S. Pat. No. 3,343,466 issued Sep. 26, 1967 discloses a carton erector apparatus and process.

U.S. Pat. No. 4,340,380 issued Jul. 20, 1982 and owned by the assignee of this invention discloses a carrier erecting mechanism.

While all of the above patents are concerned with erecting cartons these patents apply primarily and exclusively to erecting basket style cartons.

SUMMARY OF THE INVENTION

According to this invention in one form, a machine for erecting a carton having a collapsible bottom includes carton pick up means for engaging one side wall of the collapsed carton and for moving the collapsed carton into a position of engagement with movable means engageable with the other side wall of the carton for imparting movement thereto which is in a direction away from the one side wall of the carton and which is movable in a transverse direction relative to said one side wall of the carton to effect erection of the carton with emphasis on erecting its collapsed bottom wall.

BEST MODE OF CARRYING OUT THE INVENTION

Figure 2:
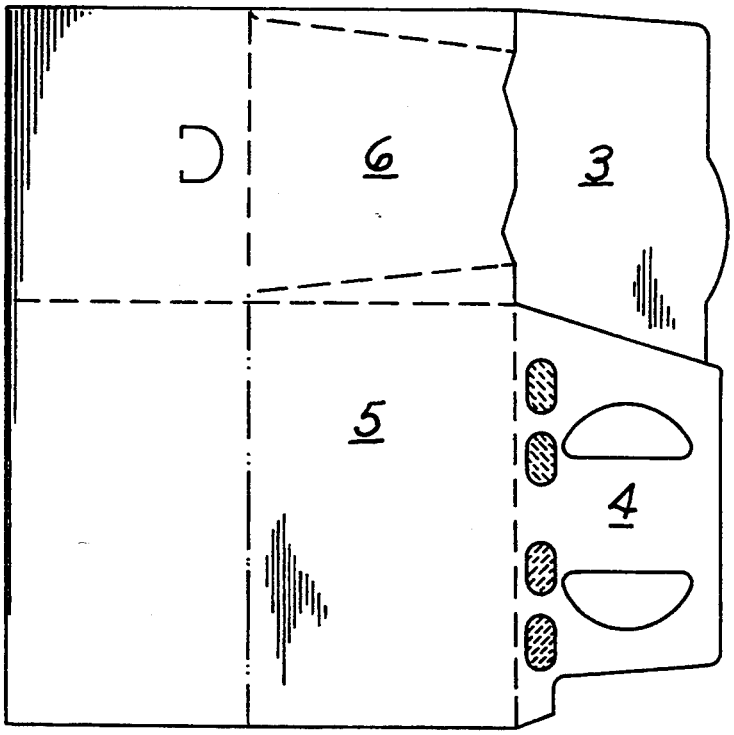
FIG. 2 shows the carton in collapsed condition as it appears when viewed from below when in the feeder hopper.
Figure 4:
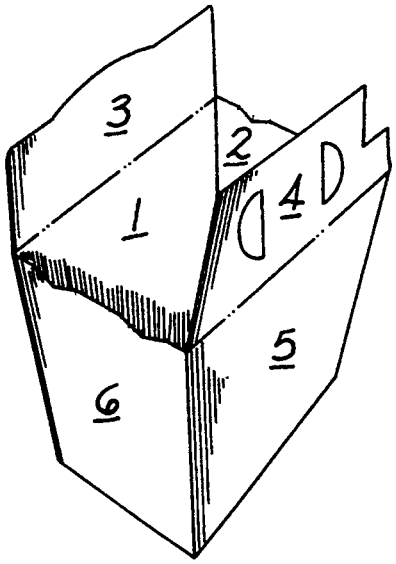
FIG. 4 shows in perspective the carton when in fully set up condition except the top panels are shown open.
Figure 6:
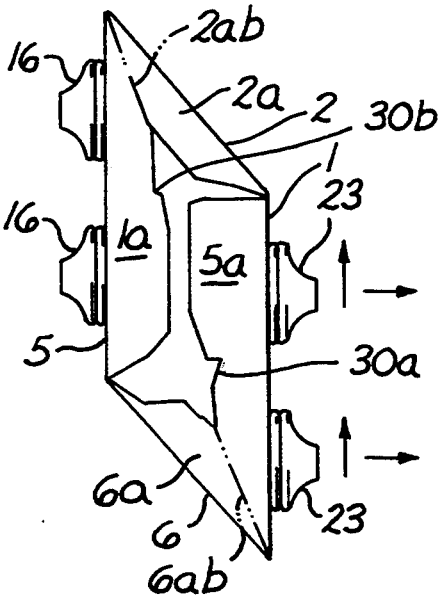
Figure 7:
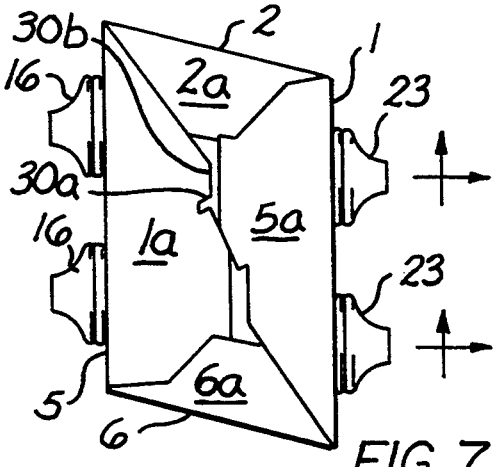
Figure 8:
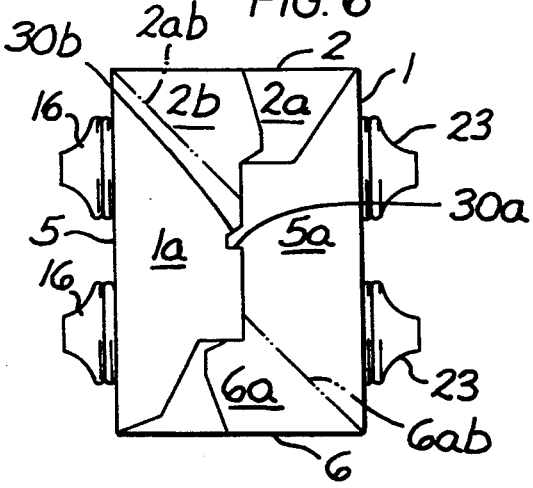

The carton as shown in FIGS. 2 and 4 includes the carton side walls 1 and 5 and the carton end walls 2 and 6 together with the top closure panels 3 and 4. FIG. 4 simply shows the top closure panels 3 and 4 in open positions. FIGS. 6, 7 and 8 are views of the bottom wall of the carton.

Figure 1:
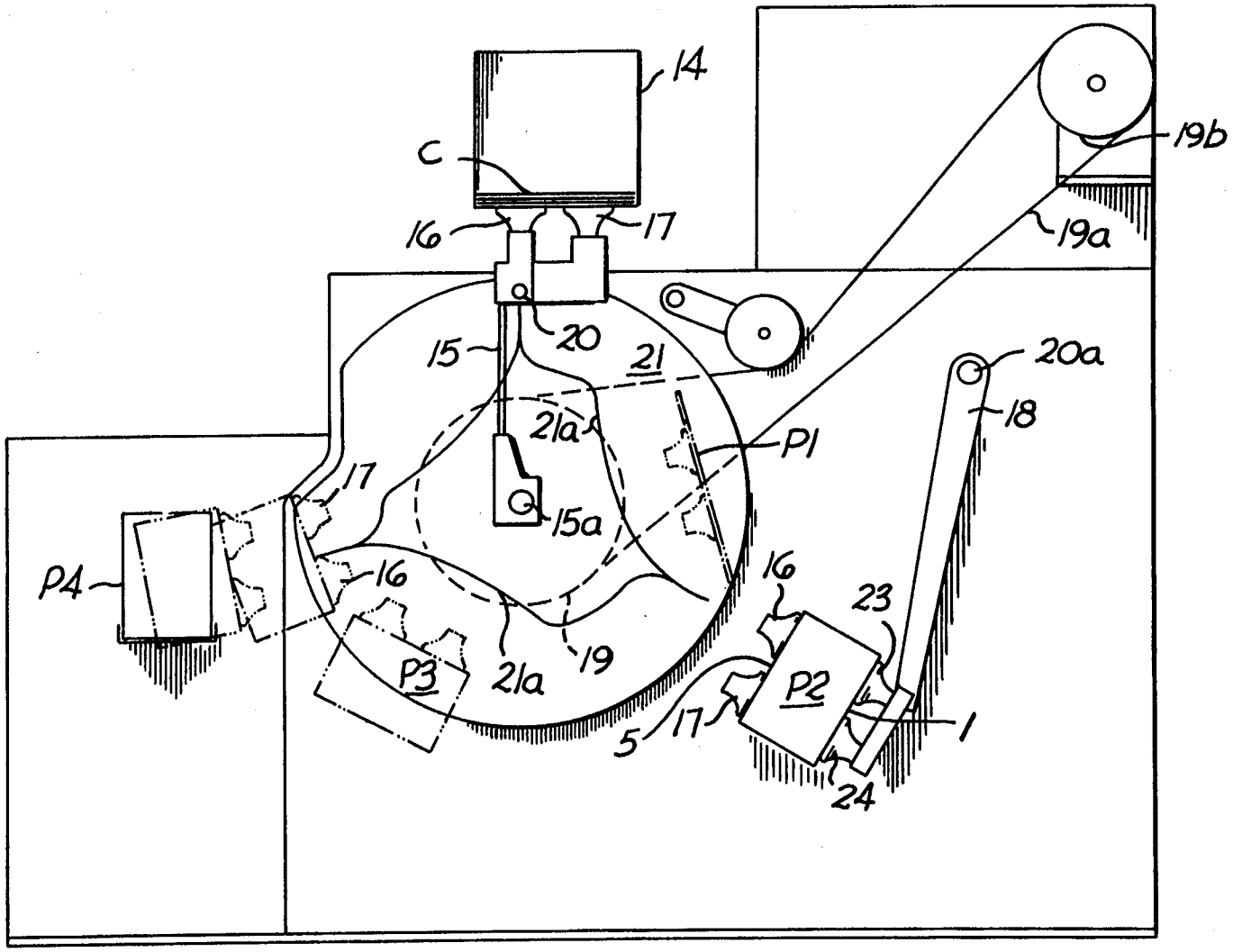
FIG. 1 is a cross sectional schematic representation of a machine formed according to this invention and includes means particularly well adapted for use in setting up a carton having a collapsible bottom wall.

Hopper 14 as shown in FIG. 1 contains collapsed cartons C and suction cups 16 and 17 are arranged to engage the lowermost carton in the hopper 14.

The mechanism including tubular member 15 is secured to horizontal tubular center shaft 15*a* which supplies suction pressure to tubular member 15 and to suction cups 16 and 17. Tubular member 15 is rotatable in a clockwise direction about center shaft 15*a* by motive means including drive wheel 19, belt 19*a* and driving wheel 19*b*. A cam follower 20 mounted on tubular member 15 rides in fixed cam plate 21 so that when operation is initiated suction pressure applied to suction cups 16 and 17 withdraws the lowermost carton in the hopper 14. The cam follower 20 rides downwardly and toward the right on cam guide 21*a* formed in fixed cam plate 21. The collapsed carton moves through position P1 and thereafter moves to position P2.

Operation of this cam mechanism is more fully shown and described in U.S. Pat. No. 4,625,575 issued Dec. 2, 1986 and owned by the assignee of this invention.

Suction cups 16 and 17 remain in secure holding engagement with the side wall 5 of the carton until the carton is moved through position P3 and is set up and ready to load at position P4.

As best shown in FIG. 1, movable means 18 is pivotally mounted at fixed pivot 20*a*. Motive means of known construction and operation causes the arm 18 to move its suction cups 23 and 24 into engagement with exposed side wall 1 of the carton and withdraws the inner surface of the carton side wall 1 away from the inner surface of side wall 5 so that the carton then occupies the position shown at P2. As is clear from FIG. 1 suction cups 23 and 24 move outward relative to position P2.

As indicated in FIGS. 6 and 7, the side walls of the carton must be moved from their collapsed condition as shown in FIG. 6 through an intermediate position shown in FIG. 7 to the fully set up position shown in FIG. 8. This requirement is achieved by the use of mechanism schematically shown in FIG. 3 which effects transverse reciprocatory motion to vacuum cups 23 and 24 which are mounted on bar 25. After the bar 25 has arrived at or near its extreme right hand position indicated at B suction pressure from cups 23 and 24 is relieved and the carton is then in set up condition.

Figure 3:
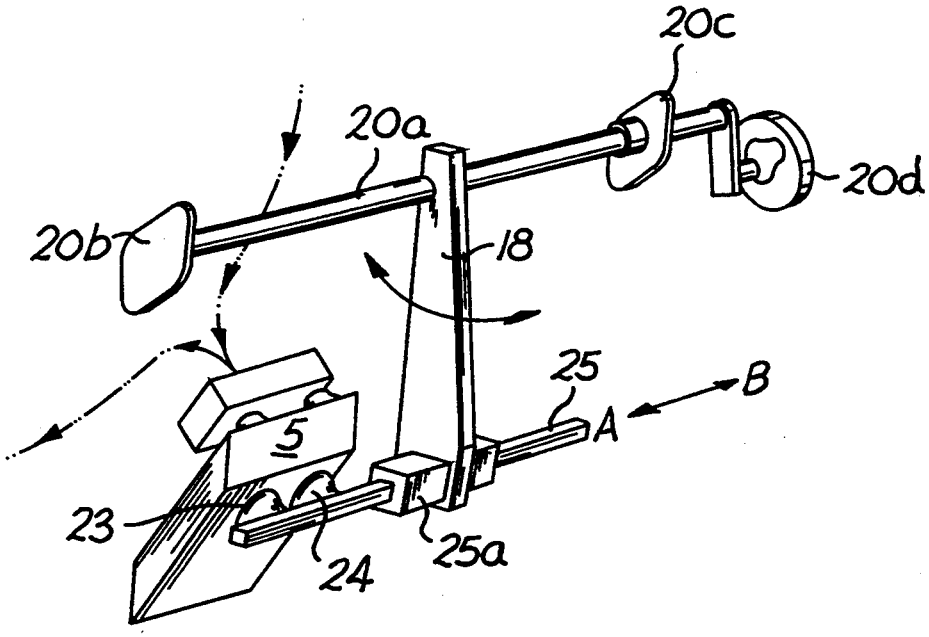
FIG. 3 is particularly well adapted for showing the reciprocal motion imparted to one carton side wall while the other carton side waist moves away from the one side wall of the carton.

As is shown in FIG. 3 shaft 20*a* is mounted in bearings 20*b* and 20*c*. Oscillatory motion is imparted to shaft 20*a* by cam 20*d*. Such motion is imparted to arm 18 and in turn to cups 23 and 24 to cause partial set up of the carton. Motion to the right of bar 25 slidably mounted on slider block 25*a* pulls the side wall 1 to the right relative to side wall 5. The collapsed carton is then in fully set up condition. Of course this procedure is well known and is repetitive under the control of a movable cam which causes reciprocatory motion of bar 25 between points A and B as indicated in FIG. 3.

As indicated in FIGS. 4, 6, 7 and 8 side wall 1 is foldably interconnected with end wall 2 and side wall 5 is foldably interconnected with end wall 6. A composite bottom wall is formed from bottom wall portions hinged to the bottom edges of said side and end walls. These bottom wall portions include panel 1*a* foldably joined to the bottom edge of side wall 5 and panel 6*a* foldably joined to the bottom edge of end wall 6. Also panel 5*a* is foldably joined to the bottom edge of side wall 1 and panel 2*a* is foldably joined to the bottom edge of end wall 2.

A securing flap is foldably joined to the bottom edge of end wall 6 and is secured in face contacting relation to panel 5*a* and these overlapping panels include coinciding diagonal fold lines.

A securing flap is foldably joined to the bottom edge of end wall 2 and is secured in face contacting relation to panel 2*a* and these overlapping panels include coinciding diagonal fold lines.

When a collapsed carton is pressed inwardly from the collapsed condition to the carton walls form a rectangle in cross section and the diagonal fold lines are positioned in general alignment with each other and notches 30*a* and 30*b* formed on the edges of panels 1*a* and 5*a* become interlocked to secure the carton in set up condition.

Figure 5:
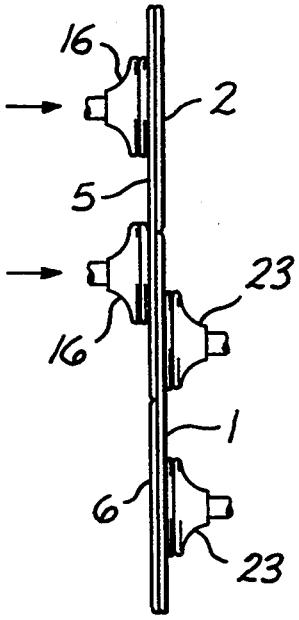
FIGS. 5, 6 and 7 show stages through which the carton is manipulated into final set up condition as viewed from the bottom wall as shown in FIG. 8.

As indicated by arrows in FIG. 6, the collapsed carton as shown in FIG. 5 is moved to the position shown in FIG. 6 due to motion toward the right of side wall 1 while side wall 5 does not move toward the right. This movement continues through the positions shown in FIGS. 7 and 8. The carton is shown as fully set up in FIG. 8. Set up condition is maintained due to engagement between locking tabs 30*a* and 30*b* as is obvious.

Suction cups 16 and 17 at this point continue to engage the set up carton and the cam follower 20 proceeds on its guide track 21*a* until the completely set up carton is moved through position P3 and into position P4 where it is ready for loading.

FIG. 4 shows in schematic perspective the side wall 5 and the end wall 6. Similarly, the numeral 1 designates a side wall and the numeral 2 designates an end wall which is foldably joined to side wall 1. Closure flap 3 is foldably joined to side wall 1 along a fold line as is obvious and flap 4 is foldably joined to side wall 5.

FIG. 5 schematically represents conditions Shown in FIG. 1 where the suction cups 16 and 17 are in engagement with side wall 5 and at which time the suction cups 23 and 24 are in engagement with side wall 1.

We claim:

1. A machine for erecting a collapsed carton having first foldably interconnected side and end walls and collapsed so that one side and one adjacent end wall extend in one plane and are disposed in face contacting relation with a second side and end wall which are disposed in an adjacent plane, and a composite bottom formed of bottom wall portions hinged to the bottom edges of said first and second side and end walls, fold lines in said bottom wall portions at diagonally disposed corners of the carton so that the bottom is automatically erected when a collapsed carton is expanded, the machine comprising revolving carton pick up means for engaging said first side walls of said collapsed cartons in sequence and transporting said cartons along a generally orbital path, movable means engageable with said second side walls at a location along said path generally offset from said pick up means for imparting movement to said second side walls in a direction away from said first side walls generally radically to the axis revolution of said pickup means, and reciprocating means for imparting movement to said movable means in a direction generally parallel to the axis of revolution of said pickup means, whereby said second side walls are moved generally transversely of said path relative to said first side walls as the carton is expanded.

2. A machine according to claim 1 wherein said other of said side walls is moved in a direction which is opposite to the direction in which the carton collapses.

3. A machine according to claim 1 wherein said movable means and said carton pick up means each comprise at least one suction cup.

4. A machine according to claim 1 wherein said movable means comprises a pivotally mounted elongated arm on which said movable means is mounted.

5. A machine according to claim 1 wherein said movable means comprises a cam controlled shaft mounted on spaced apart bearings.

6. A machine according to claim 4 wherein a slider block is mounted on said elongated arm.

7. A machine according to claim 6 wherein a reciprocally movable slider bar is slidably mounted on said slider block.

8. A machine according to claim 7 wherein means are provided for preventing rotatable movement of said slider bar relative to said slider block.

9. A machine according to claim 6 wherein said slider block is fixedly secured to said elongated arm.

* * * * *

UNITED STATES PATENT AND TRADEMARK OFFICE

CERTIFICATE OF CORRECTION

PATENT NO. : 5,411,464

DATED : MAY 2, 1995

INVENTOR(S) : RODNEY K. CALVERT and Alton J. Fishback

It is certified that error appears in the above-identified patent and that said Letters Patent is hereby corrected as shown below:

Column 4, line 12 "radically" should read - radially -

Signed and Sealed this

Eighteenth Day of July, 1995

Bruce Lehman

*Attest:*

BRUCE LEHMAN

*Attesting Officer*

*Commissioner of Patents and Trademarks*